US007001478B2

(12) United States Patent
Habisreitinger et al.

(10) Patent No.: US 7,001,478 B2
(45) Date of Patent: Feb. 21, 2006

(54) ADHESIVE APPLICATION TOO AND METHOD FOR THE AUTOMATED AND SERIAL APPLICATION OF ADHESIVE TAPE

(75) Inventors: Uwe Habisreitinger, Lossburg (DE); Bernhard Nordmann, Boeblingen (DE); Wolfram Walter, Neuhausen (DE)

(73) Assignee: DaimlerChrysler AG, Stuttgart (DE)

( * ) Notice: Subject to any disclaimer, the term of this patent is extended or adjusted under 35 U.S.C. 154(b) by 66 days.

(21) Appl. No.: 10/333,263

(22) PCT Filed: Jul. 7, 2001

(86) PCT No.: PCT/EP01/07868

§ 371 (c)(1),
(2), (4) Date: Jun. 16, 2003

(87) PCT Pub. No.: WO02/08102

PCT Pub. Date: Jan. 31, 2002

(65) Prior Publication Data

US 2004/0026026 A1 Feb. 12, 2004

(51) Int. Cl.
*B32B 31/00* (2006.01)

(52) U.S. Cl. ..... 156/270; 156/523

(58) Field of Classification Search ..... 156/71, 156/269, 270, 523, 539, 543, 574, 576, 577
See application file for complete search history.

(56) References Cited

U.S. PATENT DOCUMENTS 5,615,531 A 4/1997 Nakai et al.

FOREIGN PATENT DOCUMENTS

| | | |
|---|---|---|
| DE | 19809515 A1 | 9/1999 |
| EP | 0193626 A1 | 9/1986 |
| GB | 2325453 A | 11/1998 |
| JP | 6-211410 | 8/1994 |
| JP | 11-193172 | 7/1999 |

OTHER PUBLICATIONS

Japanese Office Action with English translations and cover letter from Japanese associate.

*Primary Examiner*—James Sells
(74) *Attorney, Agent, or Firm*—Crowell & Moring LLP

(57) ABSTRACT

Taping down tool and method for the automated, series application of adhesive tape, in particular on surface parts of vehicle bodies. The taping down tool comprises a mount for an adhesive-tape roll containing adhesive tape to be applied, an application roller for the application of adhesive tape, which has been pulled off from the adhesive-tape roll, and a holding device, which is arranged upstream of the application roller, for holding ready adhesive tape, which has been pulled off from the adhesive-tape roll, between two application processes, the holding device moreover serving for the pressing-on of held-ready adhesive tape on the surface to be covered, so as to initiate an application process, and, after a forwards movement of the taping down tool, adhesive tape, which has been pressed on by the holding device, being taken over by the application roller which can be extended essentially perpendicular with respect to the plane of the pressed-on adhesive tape in the direction of the adhesive tape and is used for the force-controlled pressing-on of the adhesive tape.

2 Claims, 2 Drawing Sheets

ADHESIVE APPLICATION TOO AND METHOD FOR THE AUTOMATED AND SERIAL APPLICATION OF ADHESIVE TAPE

The present invention relates to a taping down tool for the automated, series application of adhesive tape, in particular on surface parts of vehicle bodies, and to a method for the automated, series application of adhesive tape by means of a robot-controlled adhesive tool of the generic type according to the precharacterizing clauses of Claims 1 and 8, both as known from the generic JP 06211410 A which is taken as a basis.

JP 06211410 A discloses a taping down tool which is provided for the automated, series application of adhesive tape, in particular on surface parts of vehicle bodies. The taping down tool has a mount for an adhesive-tape roll containing adhesive tape to be applied, an application roller for the application of adhesive tape which has been pulled off from the adhesive-tape roll, and a holding device, which is arranged upstream of the application roller, for holding ready adhesive tape, which has been pulled off from the adhesive-tape roll, between two application processes, the holding device moreover serving for pressing held-ready adhesive tape on the surface which is to be covered, so as to initiate an application process. Furthermore, a means is provided enabling, after a forwards movement of the taping down tool, adhesive tape which has been pressed on by the holding device to be taken over by the application roller which can be extended essentially perpendicular with respect to the plane of the pressed-on adhesive tape in the direction (y) of the adhesive tape. With the taping down tool, adhesive tape which has been pulled off from the adhesive-tape roll is pressed by means of the holding device of the taping down tool onto a surface which is to be covered and ceases to be held on the holding device. The taping down tool is moved a few centimeters in the covering direction (x), the application roller of the taping down tool, which roller is arranged downstream of the holding device, is extended in the direction (y) of the adhesive tape until the application roller acts upon the adhesive tape and presses it onto the surface to be covered. Furthermore, the taping down tool is moved by the desired length of the covering, in which case the holding device holds an adhesive-tape section lying in the region of the holding device. The adhesive tape is then severed between the holding device and application roller and the application roller (28) is retracted again.

In the series production of many vehicle manufacturers, the vehicles have to be prepared for dispatch in such a manner that they do not become damaged, in particular in such a manner that the paintwork is not impaired by the effects of transportation and weather. For this purpose, the vehicle bodies are protected by means of self-adhering films in their essentially horizontal surface parts which are at risk from the weather and deposits. DE 198 09 515 A1 discloses an automated, robot-controlled application of self-adhering protective film on vehicle bodies for the protection of vehicles. Within the scope of the application of the protective films on parts of the vehicle body, edges of the applied films which are exposed to the winds are taped down with a narrower securing adhesive tape. For this purpose, DE 198 09 515 A1 discloses the use of a (likewise robot-controlled) taping down tool which has two respective mounts for a roll containing film material and a roll containing securing adhesive tape. Each roll is assigned a compensating roller for pulling off in a defined manner. For each tape tape holders are provided and cutting-off units which are arranged downstream of the tape holders. A tape gripper and a pressing-on roll are provided below the cutting-off units. For the application of adhesive a compensating roller for pulling off in a defined manner. For each tape tape holders are provided and cutting-off units which are arranged downstream of the tape holders. A tape gripper and a pressing-on roll are provided below the cutting-off units. For the application of adhesive tape (or film strips), the respectively desired tape is grasped at the beginning of the tape by the tape gripper and is then guided around the pressing-on roll in such a manner that the adhesive side of the gripped tape points outwards. The taping down tool together with the pressing-on roll can now be lowered onto the vehicle body section which is to be covered, with the result that the beginning of the tape lying around the pressing-on roll bears and adheres with its adhesive side on the vehicle body. After that, the tape gripper lets go of the tape and moves back into its inoperative position. By means of a slight moving back of the taping down tool and of the pressing-on roll, the beginning of the tape is pressed on in a correctly fitting manner. Subsequently, the taping down tool is moved forwards over the vehicle body and, via the pressing-on roll, presses the tape onto the vehicle body. The pressing-on roll is advantageously suspended in a dancing manner in order to obtain the necessary pressing-on pressure, to be able to optimally follow the contour of the vehicle body and to compensate for tolerances of the vehicle body. After the desired tape length has been applied minus a cutting-off length which is to be taken into consideration, the tape is cut off in an accurately fitting manner using the cutting-off unit and the cutting-off length is pressed on by further forwards movement of the pressing-on roll. Subsequently, the tape gripper grips the beginning of the tape of the next tape required and the application cycle begins anew.

In contrast, the invention proposes a taping down tool for the automated, series application of adhesive tape having the features of Claim 1 and a method for the automated, series application of adhesive tape having the features of Claim 7.

Accordingly, the invention proposes a taping down tool having a mount for an adhesive-tape roll with adhesive tape to be applied, an application roller for the application of adhesive tape, which has been pulled off from the adhesive-tape roll, and a holding device, which is arranged upstream of the application roller, for holding ready adhesive tape, which has been pulled off from the adhesive-tape roll, between two application processes, in which the holding device moreover serves for the pressing-on of held-ready adhesive tape on the surface to be covered, so as to initiate an application process, in which case, after a forwards movement of the taping down tool, adhesive tape, which has been pressed on by the holding device, is taken over by the application roller which can be extended essentially perpendicular with respect to the plane of the pressed-on adhesive tape in the direction of the adhesive tape.

In a refinement of the invention, the holding device holds adhesive tape by means of application of negative pressure.

In a further refinement of the invention, the holding device has a bearing and press-on surface against which adhesive tape, which has been pulled off from the adhesive-tape roll, bears and by means of which the adhesive tape is pressed on the surface to be covered, so as to initiate an application process.

In a particularly advantageous development of the invention, the bearing and press-on surface of the holding device has a plurality of openings for the application of negative pressure, and a coating consisting of pliable, flexible material, such as soft rubber.

In a further refinement of the invention, a cutting device is provided between the holding device and application roller, which device can be adjusted essentially perpendicular with respect to the plane of the adhesive tape into a position in which it acts upon and severs the adhesive tape. The cutting device preferably comprises a heatable wire.

The method according to the invention is distinguished by the following steps:

- pressing of adhesive tape, which has been pulled off from an adhesive-tape roll, onto a surface to be covered by means of a holding device of the taping down tool,
- ending the holding of the adhesive tape on the holding device,
- movement of the taping down tool by a few centimeters in the covering direction,
- extension of an application roller of the taping down tool, which roller is arranged downstream of the holding device, in the direction of the adhesive tape until the application roller acts upon the adhesive tape and presses it onto the surface to be covered,
- movement of the taping down tool by the desired length of the covering,
- inclination of the taping down tool,
- resuming the holding by the holding device of adhesive tape lying in the region of the holding device,
- severing the adhesive tape between holding device and application roller,
- retraction of the application roller.

In an advantageous development of the invention, after the severing of the adhesive tape and before the retraction of the application roller, the end of the applied adhesive-tape section is rolled down firmly by the application roller.

In a preferred refinement of the invention, the press-on force, with which the adhesive tape is pressed onto the vehicle body section to be covered, can be varied and controlled in its magnitude. The controlling of the press-on force advantageously takes place as a function of the requirements made of the adhesive connection, i.e. adhesive force of the adhesive tape to be applied, surface condition of the vehicle body section to be covered, and the like. The controlling of the press-on force preferably takes place via a proportioning valve which is controlled via robot control. According to the invention, the force-controlled pressing-on of the adhesive tape takes place by means of the application roller and/or the bearing and press-on surface.

Further advantages and refinements of the invention emerge from the description and the attached drawing.

It goes without saying that the features which are mentioned above and those which have yet to be explained below can be used not only in the respectively given combination, but also in other combinations or on their own without departing from the scope of the present invention.

The invention is illustrated schematically with reference to an exemplary embodiment in the drawing and will be described in detail below with reference to the drawing.

FIG. 1 shows a highly schematized schematic illustration of a taping down tool according to the invention in order to show its manner of functioning while

Figure 1:
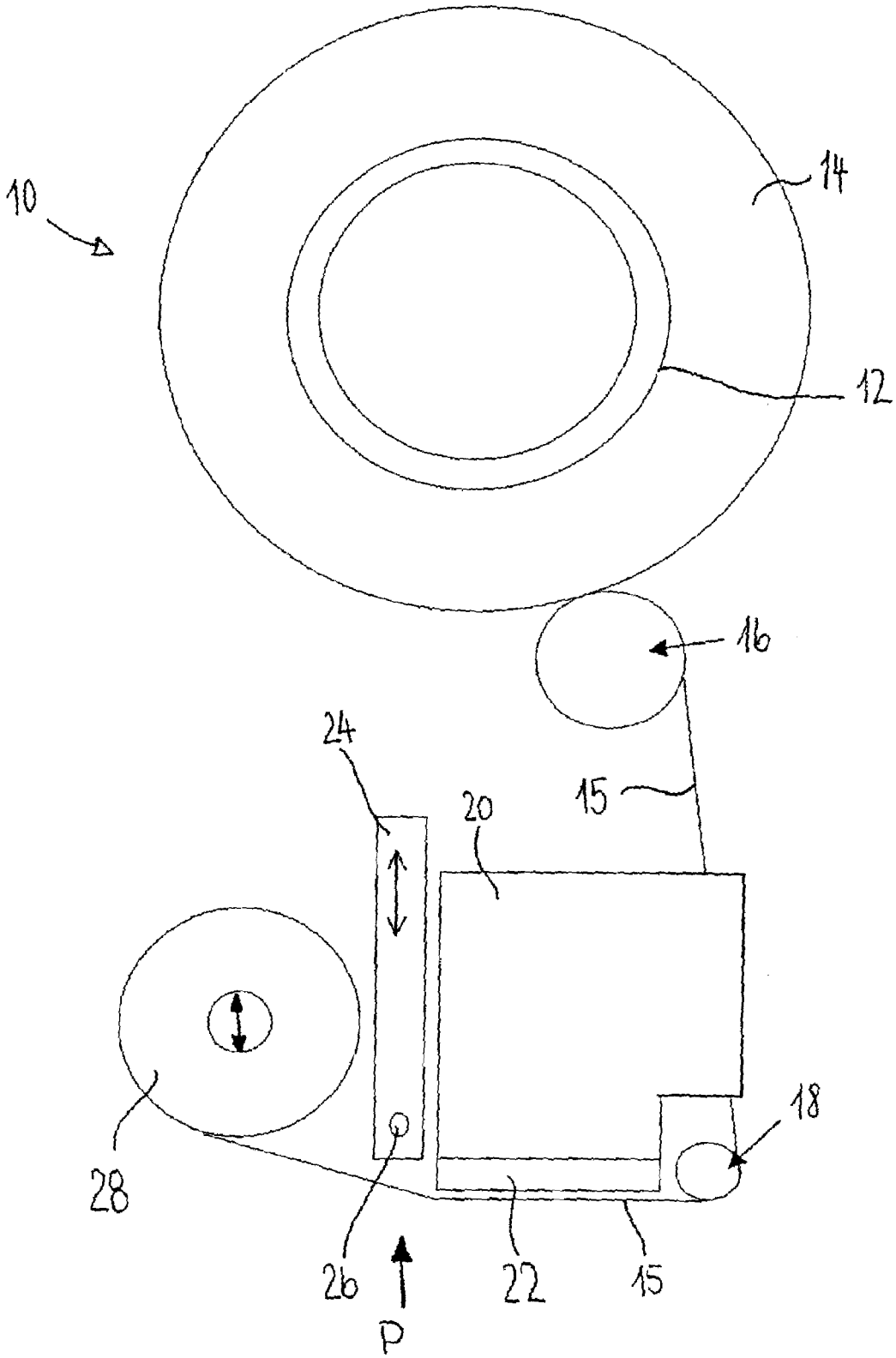
FIG. 1 shows a highly schematized schematic illustration of a taping down tool according to the invention in plan view.
Figure 2:
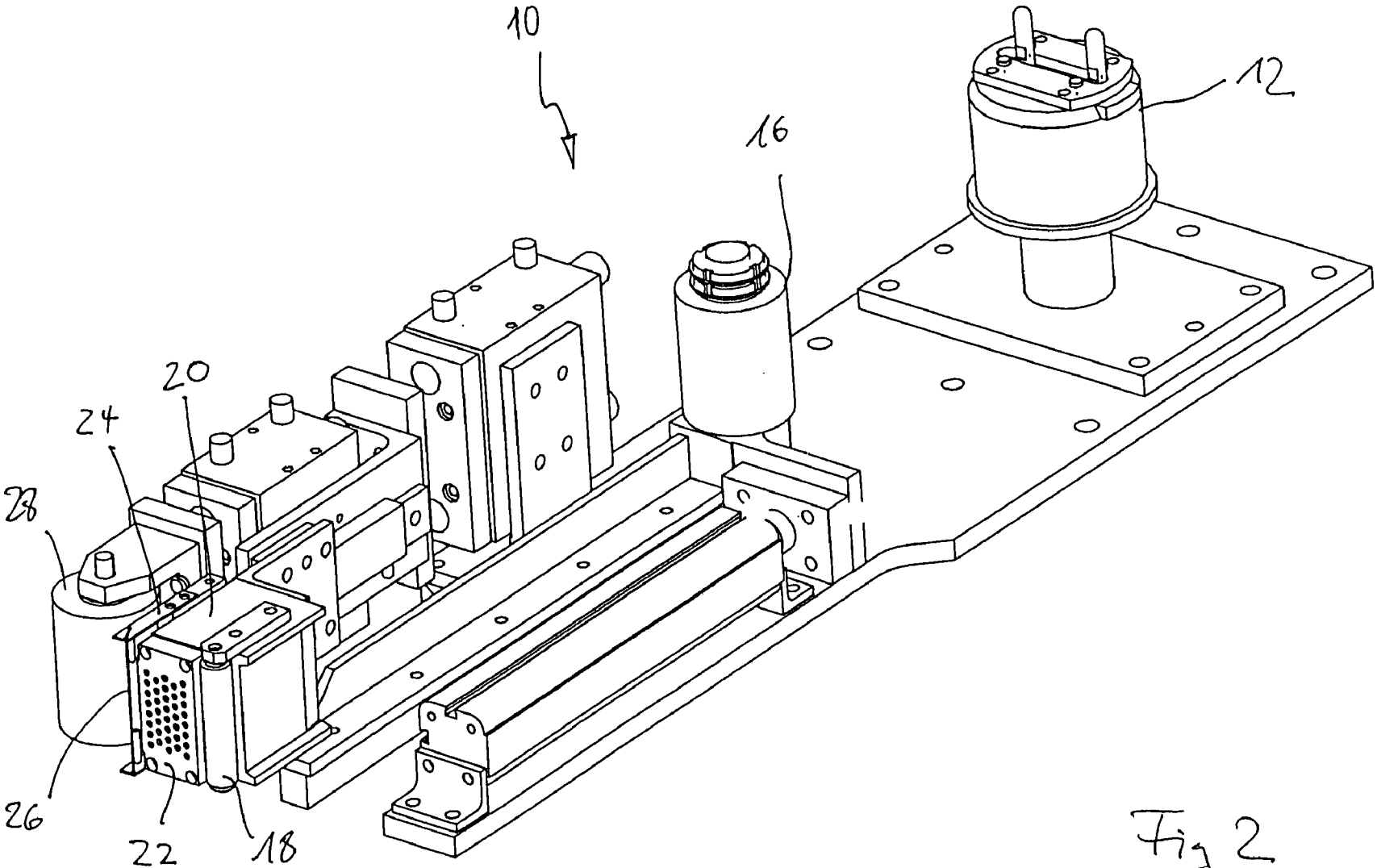
FIG. 2 shows a perspective illustration of a taping down tool according to the invention without the adhesive-tape roll inserted.

The taping down tool 10 according to the invention comprises a mount 12 for an adhesive-tape roll 14 and a pressing roll 16 which, when the adhesive-tape roll 14 is inserted, acts upon the latter, on the circumferential surface thereof (when the central axes are parallel) and serves for the defined pulling off of adhesive tape from the adhesive-tape roll 14. Adhesive tape 15 which has been pulled off from the adhesive-tape roll 14 is guided about the pressing roll 16 and about a guide and deflecting roll 18, which is arranged downstream, in such a manner that the adhesive side of the adhesive tape 15 faces outwards, i.e. away from the taping down tool 10.

The guiding and deflecting roller 18 is used to deflect the adhesive tape 15 and guide it in front of a holding device 20, which is a negative-pressure or vacuum unit. That side of the holding device 20 which faces the adhesive tape 15 is designed as a bearing and press-on surface 22 which has a coating consisting of pliable, flexible material (such as, for example, soft rubber) and in which a plurality of openings are provided through which negative pressure is applied to the adhesive tape 15 guided in front of the bearing and press-on surface 22.

Furthermore, an application roller 28 arranged downstream of the holding device 20 (in the pull-off direction of the adhesive tape) is provided. The application roller 28 serves for rolling the adhesive tape onto a surface to be covered, in particular a surface part of a motor-vehicle body.

Furthermore, a cutting device 24 is provided between the holding device 20 and the application roller 28, which device comprises a heatable wire 26 at its end facing the adhesive tape 15.

Both the application roller 28 and the cutting device 24 can be adjusted in a freely moveable manner in the y-direction of the robot coordinate system (cf. FIG. 1), i.e. in the direction perpendicular with respect to the plane of the adhesive tape held ready on the holding device 20. The holding device 20 is preferably also designed in a manner such that it can be adjusted in this direction.

The manner of functioning of the taping down tool according to the invention is as follows:

Before an application process, adhesive tape 15, which has been pulled off from the adhesive-tape roll 14, is guided around the pressing roll 16 and the guiding and deflecting roll 18 and past the holding device 20 to a point below the cutting device 24 (which point is identified in FIG. 1 by the arrow P) and is held by the holding device 20 against the bearing and press-on surface 22 by means of application of negative pressure or a vacuum.

In order to initiate the application process, the robot arm places the taping down tool 10 in the y-direction on the surface to be covered in such a manner that the adhesive tape 15 is placed below the bearing and press-on surface 22 onto the surface to be covered and is stuck to it there. Owing to the coating of the bearing and press-on surface with a pliable, flexible material, a slight pressure can be exerted by the robot without the surface which is to be covered being damaged. In addition, surface tolerances in the surface which is to be covered can be compensated for in this manner.

Next, the application of negative pressure or a vacuum by the holding device 20 is switched off, so that the adhesive tape 15 is no longer held on the bearing and press-on surface. In order to improve the "effect of letting go", a reversal of pressure can take place, for example in the form of a slight application of positive pressure or letting pressure off.

The robot then moves the taping down tool 10 in the covering direction, i.e. essentially in the x-direction, along the surface which is to be covered. This movement takes place merely for a few centimeters, specifically until the application roller 28 is situated above the stuck-on adhesive tape. The application roller 28, which is arranged downstream of the holding device 20, is then extended in the direction of the adhesive tape until it acts upon the adhesive tape 15 and presses it onto the surface to be covered. The movability of the application roller 28 is shown in FIG. 1 by the double arrow provided. The extension of the application roller 28 is set in such a manner that the application roller 28 in its end position protrudes further than the bearing and press-on surface 22 of the holding device 20. This is obtained either by the application roller 28 being extended by a corresponding extent or by the holding device 20 being moved back somewhat, if it is of adjustable design—as already described.

Next, the taping down tool 10 is moved in the covering direction by the desired length of the covering, in which case the application roller 28, which advantageously has a soft coating, presses the adhesive tape 15 onto the surface to be covered.

As soon as the desired adhesive length has been reached (minus an overshoot), the robot preferably inclines the taping down tool in such a manner that the guiding and deflecting roller 18 is raised relative to the application roller 28, and the holding function of the holding device 20 is activated again by switching on the application of negative pressure. The cutting device 24 then moves in the y-direction (cf. inserted double arrow), i.e. essentially perpendicular with respect to the plane of the adhesive tape, into a position in which it acts upon and severs the adhesive tape 15, the severing being obtained by heating the wire 26, and then moves back again.

As final step of the application process, the end of the applied adhesive-tape section is rolled down firmly by the application roller 28 and the application roller 28 is retracted again.

The configuration according to the invention of a taping down tool permits a simplified construction, since the holding and pressing-on of the adhesive tape takes place using a single holding device with a combined function. In particular, separate means for holding, gripping and feeding the free adhesive-tape end to an application roller are not necessary. The simplified construction of the taping down tool according to the invention also results in a simplification of the application process, in which, in particular, the times between two application processes can be shortened, since the free adhesive-tape end is already situated on the press-on surface with which it is pressed onto the surface to be covered. The taping down tool according to the invention therefore permits time-optimized, reliable, automated application of tapes, in particular adhesive tapes, even on sensitive surfaces.

The invention claimed is:

1. A method for automated, series application of adhesive tape by way of a robot-controlled taping down tool, comprising:

pressing adhesive tape, which has been pulled off from an adhesive tape roll, onto a surface to be covered by way of a holding device of the taping down tool so that the tape ceases being held on the holding device, moving the taping down tool a few centimeters in a covering direction, extending an application roller of the taping down tool which is arranged downstream of the holding device in a direction of the adhesive tape until the application roller acts upon the adhesive tape and presses it onto the surface to be covered, moving the taping down tool by a desired length of covering and holding an adhesive-tape section lying in the region of the holding device with the holding device, inclining the taping down tool so as to raise a guiding and deflecting roller relative to the application roller, and holding the adhesive tape by the holding device by application of negative pressure, severing the adhesive tape between the holding device and application roller, and retracting the application roller again.

2. The method according to claim 1, and further comprising rolling an end of the applied adhesive-tape section down firmly by the application roller after severing the adhesive tape and before retracting the application roller.

* * * * *